US007775400B2

(12) United States Patent
Wohlgenannt et al.

(10) Patent No.: US 7,775,400 B2
(45) Date of Patent: Aug. 17, 2010

(54) ROTATABLE, RECLOSABLE CLOSURE

(75) Inventors: Herbert Wohlgenannt, Thayngen (CH); Stefan Gaul, Schaffhausen (CH)

(73) Assignee: Capartis AG, Schaffhausen (CH)

( * ) Notice: Subject to any disclaimer, the term of this patent is extended or adjusted under 35 U.S.C. 154(b) by 405 days.

(21) Appl. No.: 11/996,175

(22) PCT Filed: Jul. 6, 2006

(86) PCT No.: PCT/EP2006/063947

§ 371 (c)(1),
(2), (4) Date: Jan. 18, 2008

(87) PCT Pub. No.: WO2007/009888

PCT Pub. Date: Jan. 25, 2007

(65) Prior Publication Data

US 2008/0210709 A1 Sep. 4, 2008

(30) Foreign Application Priority Data

Jul. 19, 2005 (EP) ..... 05106620

(51) Int. Cl.
*B67D 1/16* (2006.01)

(52) U.S. Cl. ..... 222/111; 222/553; 222/566; 222/567

(58) Field of Classification Search ..... 222/111, 222/507, 513, 516, 553–554, 519, 562, 528, 222/530, 548, 545, 566–567, 569; 215/313, 215/321; 220/253
See application file for complete search history.

(56) References Cited

U.S. PATENT DOCUMENTS 3,278,095 A * 10/1966 Johns ..... 222/507

(Continued)

FOREIGN PATENT DOCUMENTS

EP 0386332 9/1990

(Continued)

*Primary Examiner*—Frederick C. Nicolas
(74) *Attorney, Agent, or Firm*—Fish & Associates, PC

(57) ABSTRACT

Disclosed is a rotatable, reclosable closure (1) comprises a base (2) and a cap (3) which is mounted so as to be twistable about a common axis of rotation (D) relative to the base (2). The base (2) encompasses an outer sleeve (2*a*) that extends coaxial to the axis of rotation (D) and is provided with a laterally protruding spout (2*b*). The cap (3) is fitted with an inner sleeve (3*a*) that runs coaxial to the axis of rotation (D) and is disposed inside the outer sleeve (2*a*). The inner sleeve and outer sleeve (3*a*, 2*a*) are designed in a mutually adapted manner such that the closure (1) features a first defined rotary position (R1) in which the interior space of the outer sleeve (2*a*) extending into the spout (2*b*) is sealed by the inner sleeve (3*a*) while the closure (1) features a second defined rotary position (R2) in which the inner sleeve (3*a*) at least partly unblocks the interior space of the outer sleeve (2*a*) towards the spout (2*b*). The cap (3) is also fitted with an g outer jacket (3*c*) which extends in the M direction of the axis of rotation (D) outside the outer sleeve (2*a*) and is provided with a hole (3*d*). The outer jacket (3*c*) lies over O and covers the spout (2*b*) in the first defined rotary position (R1) while the hole (3*d*) lies over the spout (2*b*) and makes the same accessible towards the outside in the second defined rotary position (R2).

17 Claims, 13 Drawing Sheets

U.S. PATENT DOCUMENTS

| | | | | | |
|---|---|---|---|---|---|
| 3,294,293 | A | * | 12/1966 | Johns | 222/507 |
| 4,207,996 | A | * | 6/1980 | Moen | 222/507 |
| 5,303,850 | A | * | 4/1994 | Connan | 222/153.07 |
| 5,785,213 | A | * | 7/1998 | Guillot | 222/553 |
| 5,954,241 | A | * | 9/1999 | Huang | 222/548 |
| 7,044,339 | B1 | * | 5/2006 | Kuo | 222/182 |
| 7,077,294 | B2 | * | 7/2006 | Nusbaum et al. | 222/153.06 |
| 2004/0050871 | A1 | | 3/2004 | Delage et al. | |
| 2004/0217138 | A1 | | 11/2004 | McKay et al. | |
| 2005/0127102 | A1 | | 6/2005 | Nusbaum et al. | |

FOREIGN PATENT DOCUMENTS

| | | |
|---|---|---|
| FR | 2567106 | 1/1986 |
| GB | 587994 | 5/1947 |
| GB | 978453 | 12/1964 |

* cited by examiner

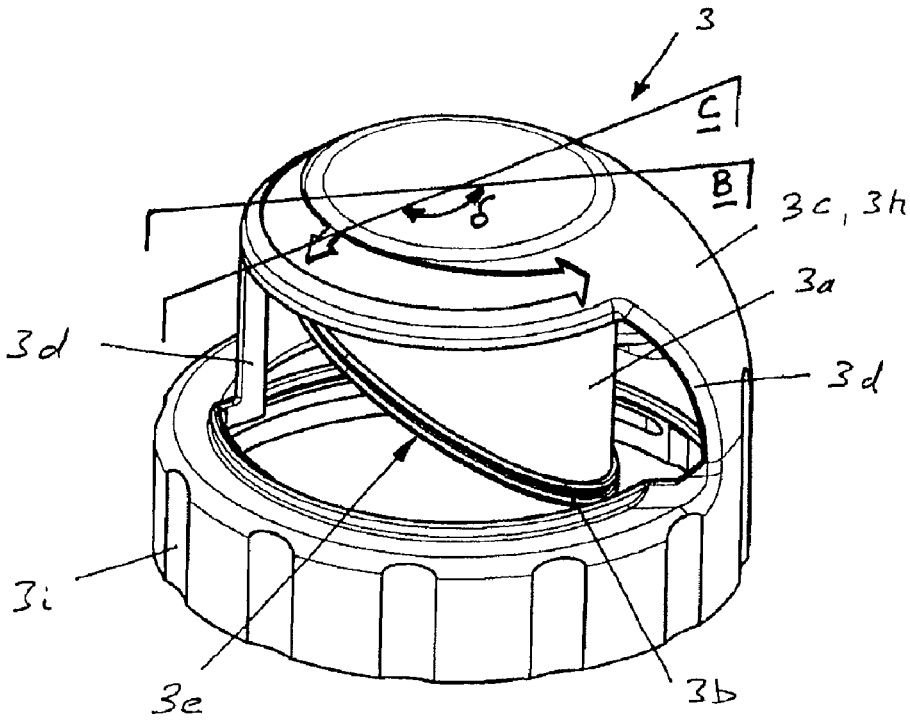
Fig.7
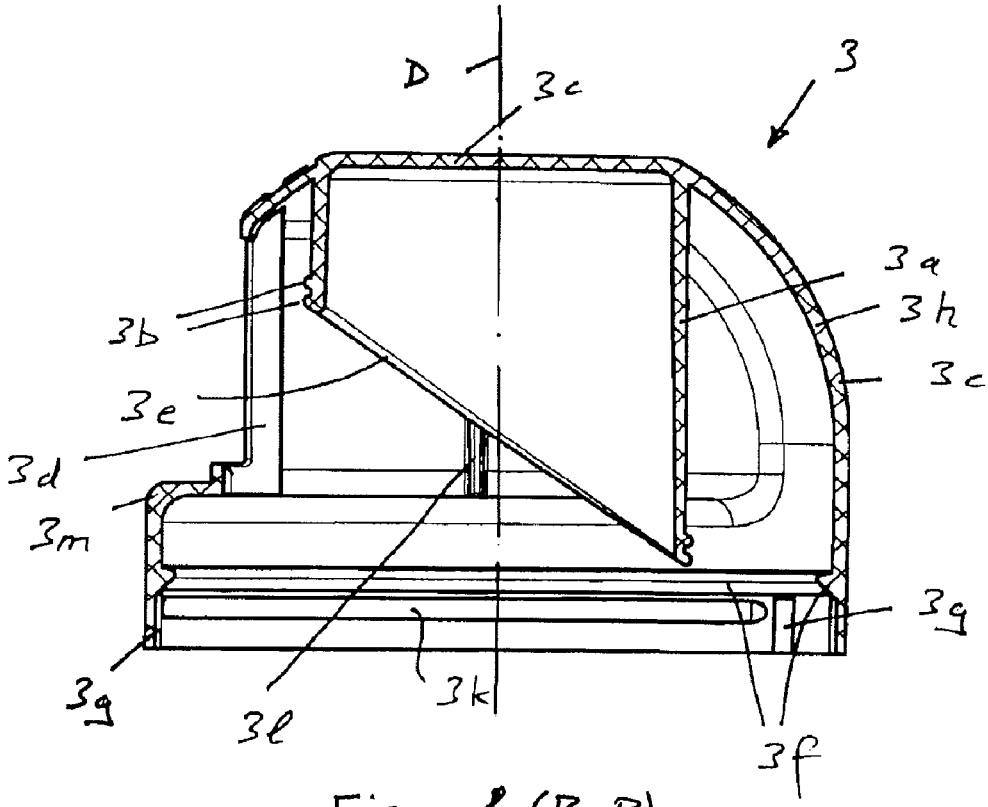
Fig. 8 (B-B)

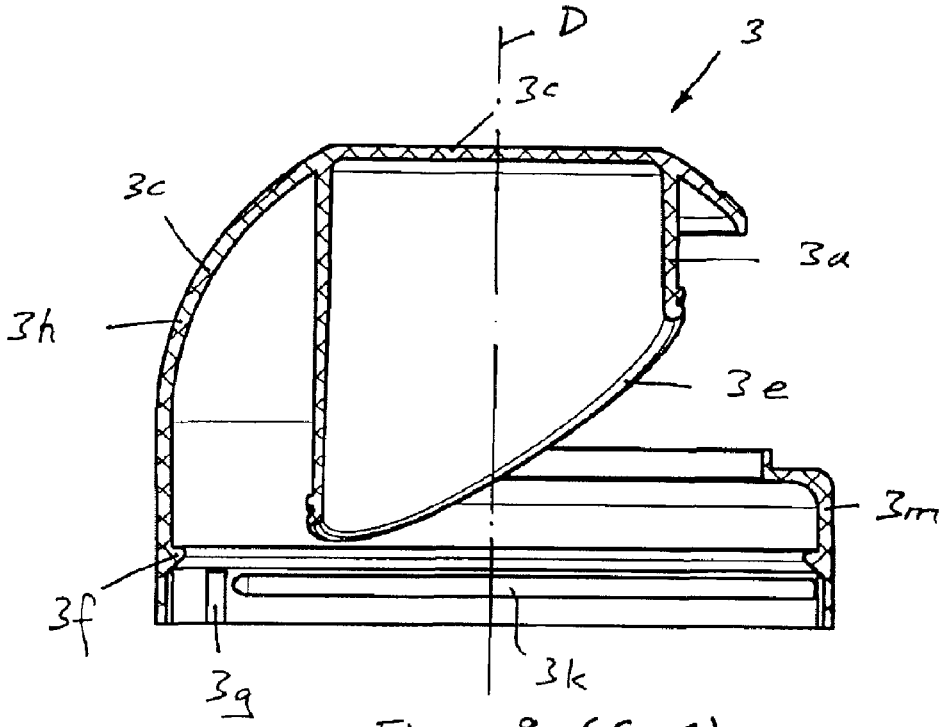
Fig. 9 (C-C)
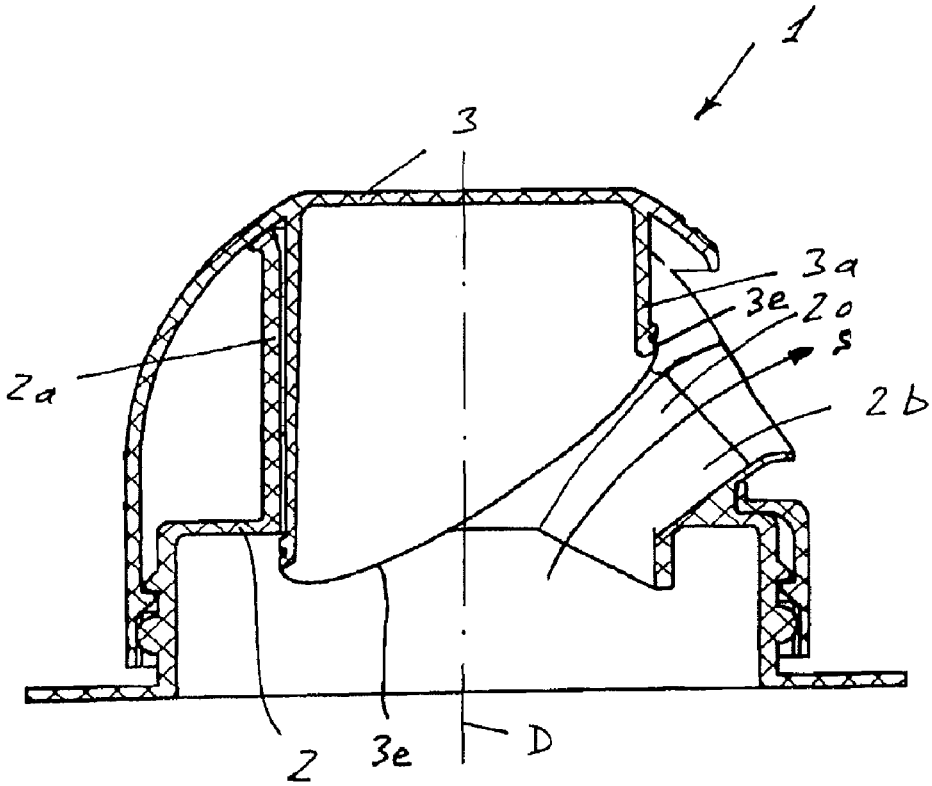
Fig. 10

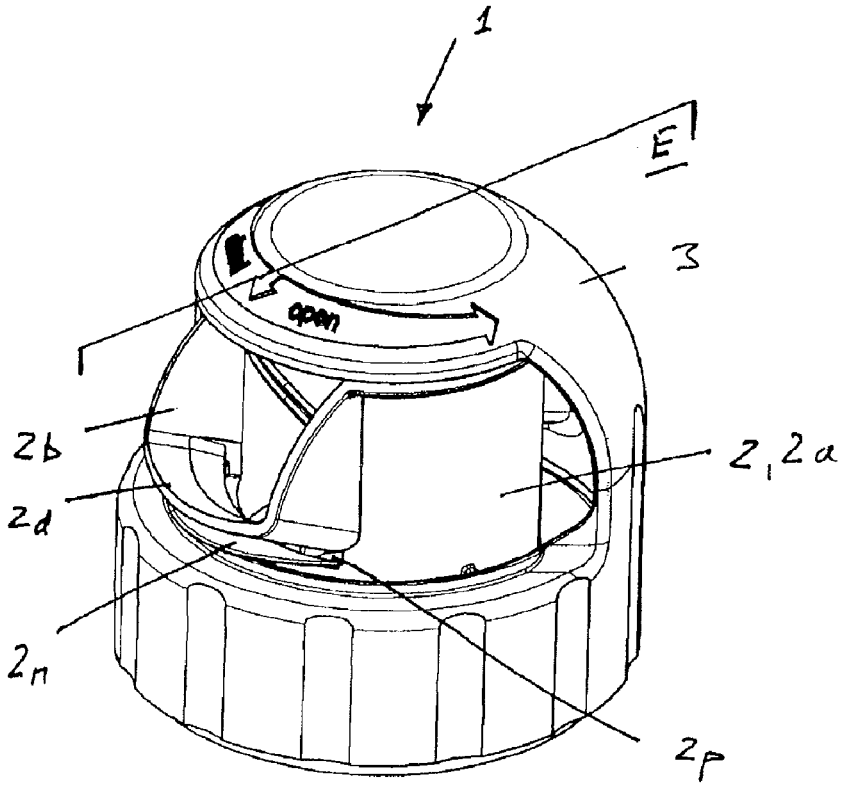
Fig. 19
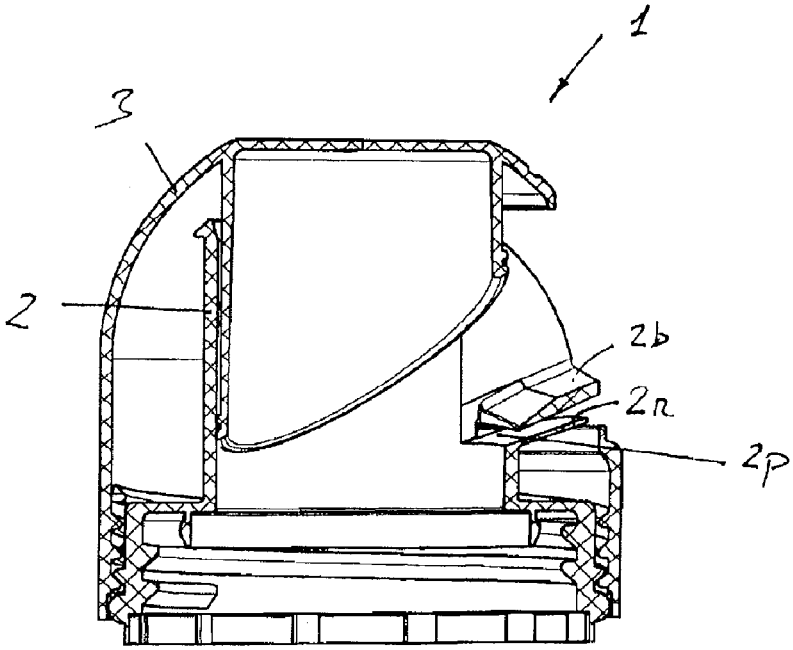
Fig. 20 (E-E)

ROTATABLE, RECLOSABLE CLOSURE

This application is a US national phase application of International patent application with the serial number PCT/EP2006/063947, which was filed Jul. 6, 2006, and claims priority to European patent application with the serial number 05106620.7, which was filed Jul. 15, 2005.

FIELD OF THE INVENTION

The invention relates to a rotatable, reclosable closure.

BACKGROUND OF THE INVENTION

Document US 2004/0026420 discloses a rotatable, reclosable closure comprising a base body as well as a closing cap. The base body has outlet openings in its side wall, with the closing cap being rotatably supported with respect to the base body and in this connection closing or opening the outlet openings of the base body in dependence on its rotational position. The closing cap is fastened to a container so that a substance can be removed from the container in dependence on the position of the closing cap.

This closure has the disadvantages that the outlet openings are relatively small, that the substance flows out in a relatively uncontrolled and undirected manner and that the outlet openings can be contaminated so that there is a risk that the contents of the container is also contaminated.

The document US 2005/127102 discloses a further reclosable rotatable closure. Both a lifting movement and a rotary movement are required for the opening and closing. This closure has the disadvantages that the opening position is difficult to find and to set. In addition, it is not possible with this rotatable closure to allow a medium, preferably a liquid, located inside the container to flow out via the outlet openings in a controlled and directed manner. In addition, drops or residues form at the outlet opening which contaminate the rotatable closure.

The document US 2004/0050871 discloses a further reclosable rotatable closure. This rotatable closure has the disadvantage that it is not possible to allow a medium, preferably a liquid, located inside the container to flow out via the outlet openings in a controlled and directed manner. In addition, drops or residues form at the outlet opening which contaminate the rotatable closure.

SUMMARY OF THE INVENTION

It is the object of the present invention to improve a closure such that it permits a simple and reliable opening and reclosing, such that it can be operated in a user-friendly manner and such that it prevents a contamination of the container, of the container contents and of the closure.

The object is in particular satisfied by a rotatable, reclosable closure comprising a base body and a closing cap, wherein the closing cap is rotatably supported around a common axis of rotation with respect to the base body, wherein the base body includes an outer sleeve extending coaxially to the axis of rotation and having a laterally projecting spout, and wherein the closing cap has an inner sleeve extending coaxially to the axis of rotation, wherein the inner sleeve is arranged inside the outer sleeve and wherein the inner sleeve and the outer sleeve are designed to match one another such that the closure has a first defined rotary position in which the inner space of the outer sleeve opening into the spout is sealed by the inner sleeve, and wherein the closure has a second defined rotary position at which the inner sleeve at least partly frees the inner space of the outer sleeve toward the spout, and wherein the closing cap has an outer jacket extending outside the outer sleeve in the direction of the axis of rotation and having an opening, wherein the outer jacket is disposed above the spout and covers it in the first defined rotary position and wherein the opening is disposed above the spout and makes it accessible to the outside in the second defined rotary position.

The closure in accordance with the invention has the advantage that it can be operated with one hand and thus enables a simple opening and closing of a container. It is in particular pleasing that the spout is arranged in the closure laterally offset with respect to the axis of rotation. In the closed state, the spout is arranged in a protected manner inside the closing cap so that the spout is protected both against contamination and against mechanical damage. In the open state, the spout projects relatively far in the radial direction toward the axis of rotation so that a pleasing, lateral and directed pouring is possible. In a particularly advantageous aspect, the spout is provided with parts which influence the flow such as lateral boundaries and/or spout lips and/or recesses and/or angles and/or a beak to influence the flow behavior of the substance to be poured out such that it flows out in a reproducible directed manner. The spout is preferably designed as a beak-shaped spout such as is used with jugs, for example. The spout extends at an acute angle with respect to the longitudinal axis of the container and/or the axis of rotation of the closure and advantageously has a section which extends in a straight line and along which the outflowing medium, in particular a liquid, adopts an at least partly aligned flow behavior so that the medium also has a preferably directed flow behavior after leaving the spout, as is usual when a beak-shaped spout is used which is also called a "pouring spout" or "pouring port" in English. In a further advantageous aspect, the spout includes at least one return and/or at least one return pan to collect any hanging drops of the poured substance remaining at the spout lip at the end of flow. The spout preferably has a relatively long design to effect a more constant outflow behavior.

The closure in accordance with the invention is suitable for substances with the most varied viscosity, for example for water, oil, liquid detergent, gels or also honey. The closure is in particular suitable for substances with viscosities greater than water or oil.

The spout preferably has a pouring opening 2*o* which is so large that a refilling of the container is also possible via the closure in accordance with the invention.

The closure in accordance with the invention moreover has the advantage that the area of the pouring opening is variable and can be set by corresponding rotation at the closure. In an advantageous aspect, the closure has a plurality of different latching positions, with each latching position corresponding to a defined area of the pouring opening. The area of the pouring opening can thus be reset in a reproducible manner at any time by a corresponding rotation of the closure top.

The invention will be explained in more detail in the following with reference to embodiments.

BRIEF DESCRIPTION OF THE DRAWING

The Figures show:

FIG. 7 a perspective view of the cap;

FIG. 8 a longitudinal section through the cap in accordance with FIG. 7 along the line B-B;

FIG. 9 a further longitudinal section through the cap, rotated with respect to FIG. 8, along the line C-C;

FIG. 10 a longitudinal section through the closure in a completely open position;

FIG. 19 a perspective view through a further embodiment of a closure;

FIG. 20 a longitudinal section through the embodiment in accordance with FIG. 19 along the line E-E;

FIG. 27 a longitudinal section through the base body shown in FIG. 26 with a closing cap placed on.

DETAILED DESCRIPTION

Figure 1:
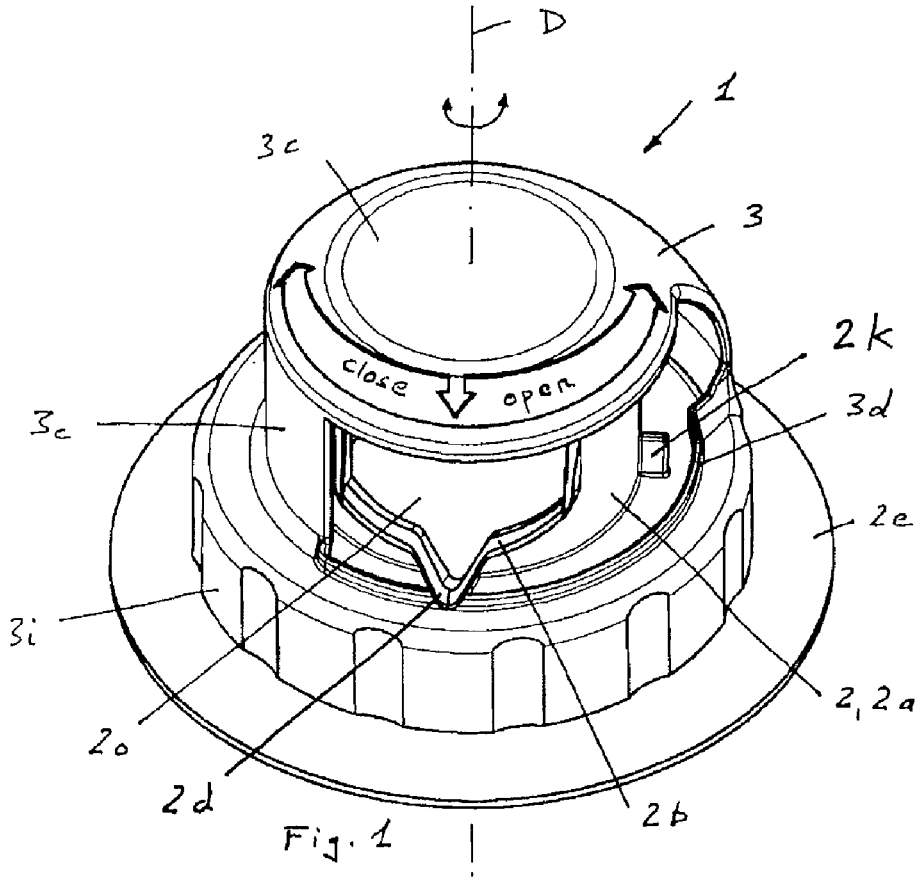
FIG. 1 a perspective view of a first embodiment of a closure in the completely open position.

FIG. 1 shows the rotatable closure 1 in a completely open position. The closure 1 consists of a base body 2 and a closing cap 3 rotatable with respect thereto around an axis of rotation D. The base body 2 in the embodiment shown includes a flange 2*e* which is firmly adhesively bonded, for example; to a container which is not shown, for example to a packaging material such as a card packaging, so that the inner space of the container can be opened and reclosed via the closure 1. The base body 2 includes an outer sleeve 2*a* with a laterally arranged spout 2*b* which forms a pouring opening 2*o*. The spout 2*b* includes a projecting spout lip 2 which extends obliquely upwardly in the view and which is designed such that the outflowing contents of the container is guided such that the contents can be supplied to a destination in a directed manner. The closing cap 3 includes an outer jacket 3*c* having an opening 3*d*. In addition, the closing cap 3 includes a knurl 3*i* which is actuable by hand to rotate the closing cap 3 in the direction of the axis of rotation D and thus to open or close the closure 1 as indicated at the top of the closing cap 3 by "open" and "close". The closing cap 3 and the base body 2 are designed matched to one another such that the spout 2*b* is disposed completely inside the closing cap 3 with a closed closure 1 and such that the spout 2*b* has a preferably large, easily accessible spout opening 2*o* with a completely open closure 1, with a spout 2*b* which allows the outflowing medium to leave, preferably in a manner as directed as possible. It can additionally prove to be advantageous to make the spout opening 2*o* so large that the contents of the container can be refilled via the spout opening 2*o*. The spout opening 2*o* advantageously has a width of more than 5 mm so that the container can be refilled, for example via the spout opening 2*o*.

Figure 2:
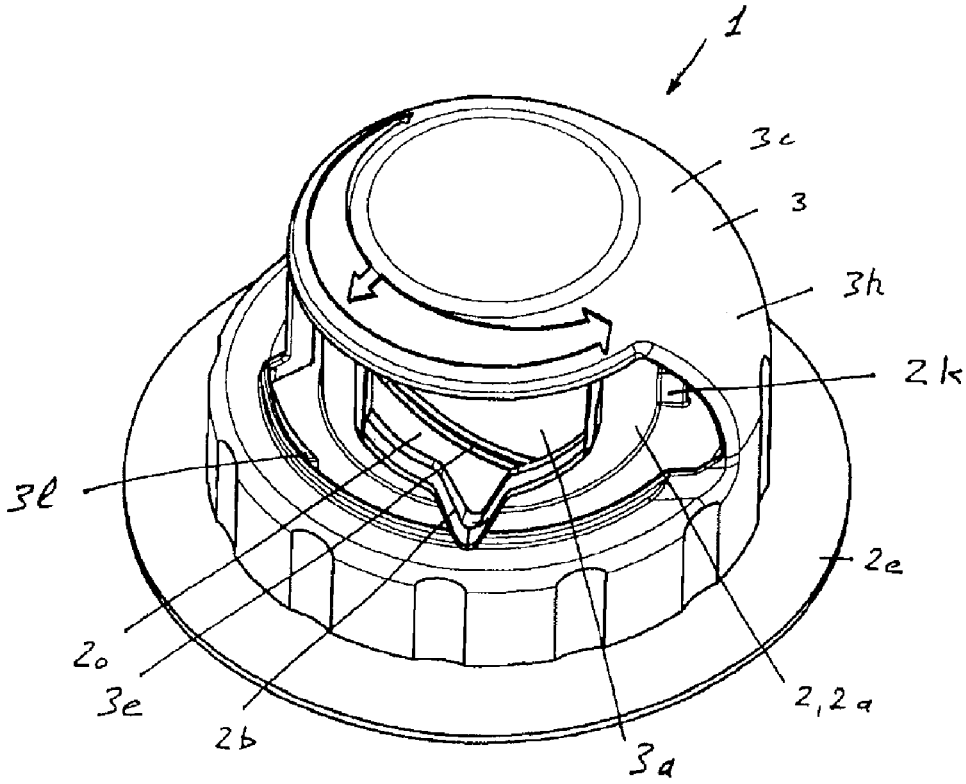
FIG. 2 a perspective view of the closure in accordance with FIG. 1 in an intermediate position.
Figure 3:
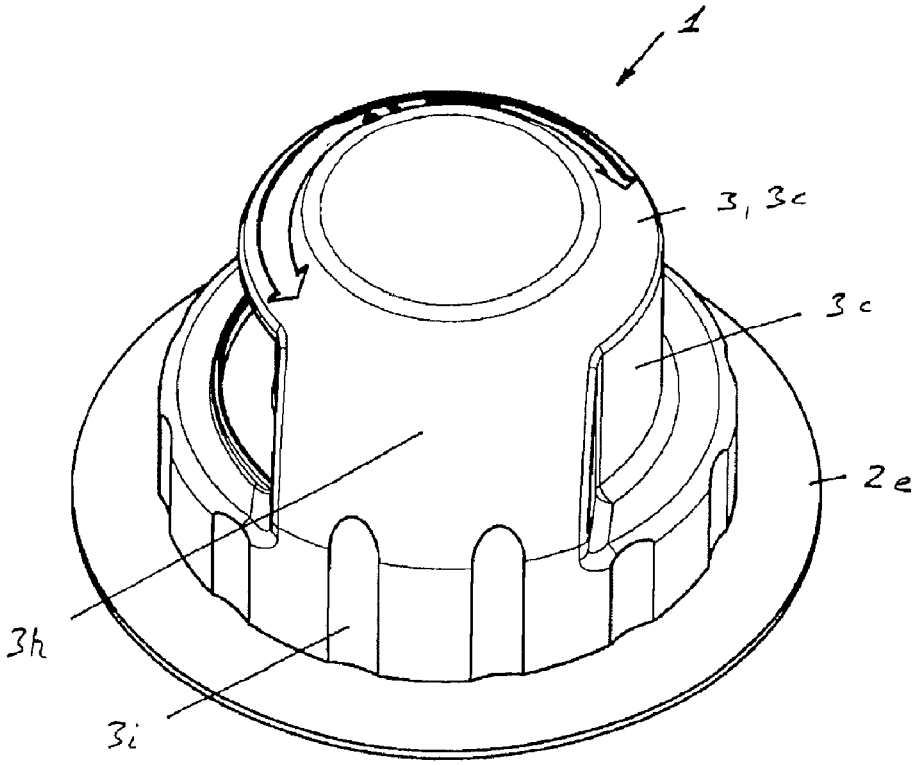
FIG. 3 a perspective view of the closure in accordance with FIG. 1 in a closed position.

FIGS. 1 to 3 show the same closure 1 in different closed positions. The base body 2 is always located in the same position in the three views shown, whereas the closing cap 3 is located in three different rotary positions R1, R2, R3. The closing cap 3 in accordance with FIG. 1 is located in a second defined rotary position R2 in which the closure is completely open. FIG. 2 shows the closing cap 3 in an intermediate position R3 in which the spout opening 2*o* is reduced by the inner sleeve 3*a* which is located partly behind the spout 2*b* and has a lower edge 3*e*. FIG. 3 shows the closing cap 3 in a first defined rotary position R1 in which the spout 2*b* is completely closed by the inner sleeve 3*a*. In addition, the spout 2*b* is covered from the outside by a cover part 3*h* of the outer jacket 3*c* so that the spout 2*b* is protected from external mechanical effects and/or from contamination.

The closure 1 shown in FIGS. 1 to 3 will now be explained in detail with the help of FIGS. 4 to 13.

Figure 4:
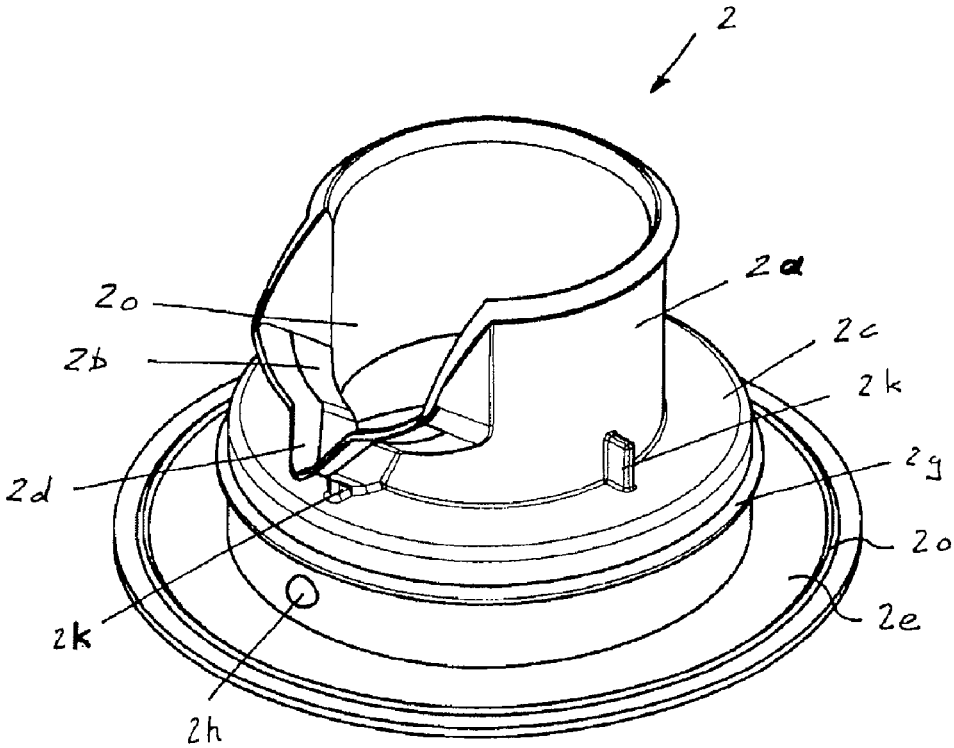
FIG. 4 a perspective view of the base body.

FIG. 4 shows a one-piece base body 2 made as an injection molded body in a perspective view. The base body 2 includes a cylindrical outer envelope 2*a* which is pierced laterally by a spout 2*b* with a spout lip 2*d*. In this representation, the spout opening 2*o* corresponds to that area of the base body 2 which is pierced by the spout 2*b*. The spout 2*b* has a pronounced spout lip 2*d* which extends into a tip or a beak and which serves to pour out the container contents, preferably a liquid or a gel, in a manner which is as directed as possible and without dripping. The base body 2 additionally includes a round guide part 2*c* which connects the outer sleeve 2*a* to a flange 2*e*. The round guide part 2*c* includes two abutment webs 2*k* which bound the maximum rotational angle of the closing cap 3. The abutment web 2*k* shown in FIG. 1 and the abutment 3*l* shown in FIG. 8 define the abutment with respect to the first defined rotary position R1 shown in FIG. 3. The abutment web 2*k* arranged beneath the spout 2*b* in FIG. 4 and the abutment 3*l* shown in FIG. 2 define the abutment with respect to the second defined rotary position R2 shown in FIG. 1. The guide web 2*c* additionally includes a projecting inner guide 2*g* extending in a circular manner and at least one projecting hemisphere 2*h*. In the embodiment shown, an energy director extending in ring shape is attached to the flange 2*e*. The energy director consists of a plastic and serves to weld the flange 2*e* to the container in the interior thereof so that the guide part 2*c* and the outer envelope 2*a* project beyond the container and the flange 2*e* is connected to the container in a fluid-tight manner.

Figure 5:
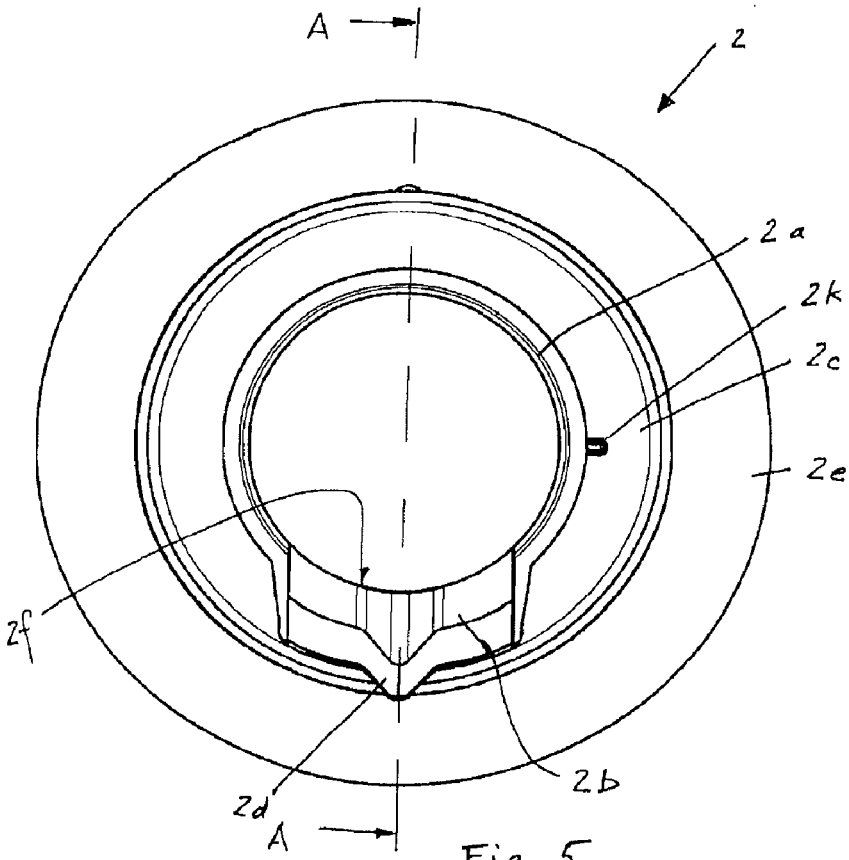
FIG. 5 a plan view of the base body in accordance with FIG. 4.

In particular the hollow-cylindrical outer sleeve 2*a* and the circular inner shape of the end section 2*f* can be seen from the plan view of the base body 2 shown in FIG. 5.

Figure 6:
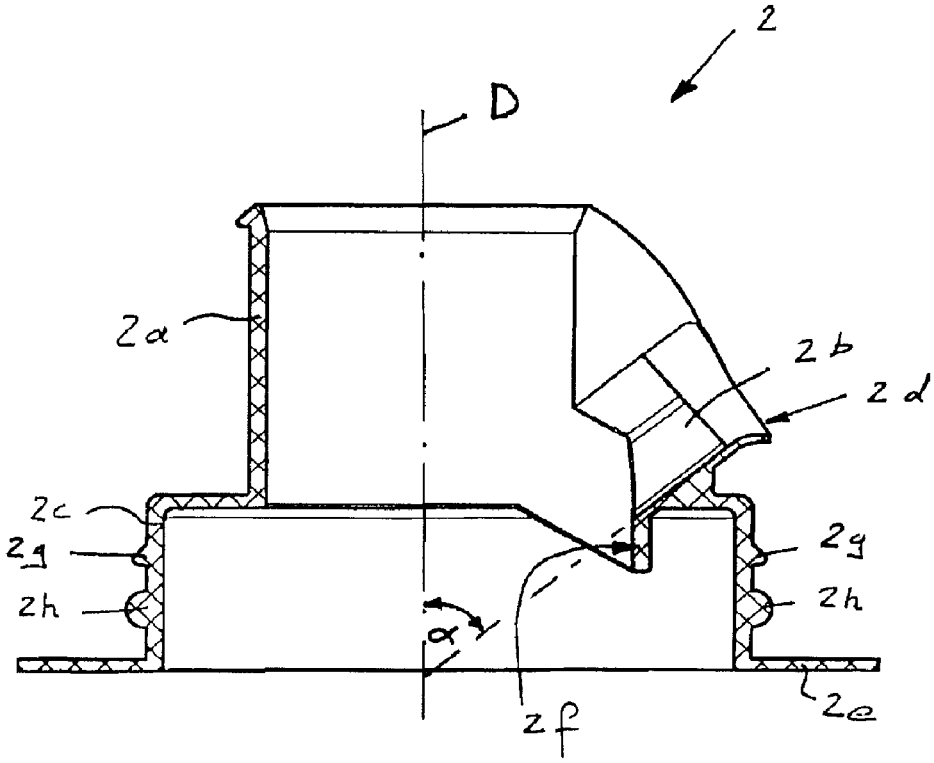
FIG. 6 a longitudinal section through the base body along the line A-A.

FIG. 6 shows a longitudinal section through the base body 2 along the line A-A shown in FIG. 5. The base body includes the outer sleeve 2*a* which merges into the spout 2*b* on the right hand side. The outer sleeve 2*a* has the guide part 2*c* at the bottom which extends all around cylindrically. The spout 2*b* widens increasingly outwardly above the guide part 2*c* in a radial direction with respect to the axis of rotation D; it therefore has a substantially conical shape and ends in the spout lip 2*d*. The spout 2*b* is made as a beak-like spout or as a pouring beak-like spout, also called a "pouring spout" or "pouring port" in English. Such a beak-like spout or such a spout can be found, for example, in cans and jugs. Such a beak-like spout has the effect that the outflowing liquid flows along the spout 2*b* and that in this connection a partly aligned flow, for example a laminar flow, arises so that the outflowing liquid adopts a predetermined and reproducible flow direction and the outflowing liquid can thereby be supplied directly to a container such as a glass, for example, on leaving the beak-like spout. The spout 2*b* extends as shown with respect to the axis of rotation D at an acute angle or obliquely, with the angle α preferably being in the region between 10 and 80°. The spout 2*b* preferably has a section with a straight-line extent as can be seen from the section shown and opens into the spout lip 2*d*. This spout lip 2*d* preferably extends as shown with a curve such that the spout lip 2*d* expands outwardly or downwardly. The spout 2*d* could also be designed with a different shape, for example extending upwardly or downwardly with a curve, in addition to the straight shape shown in the sectional drawing. This spout lip 2*d* can, as shown for example in FIGS. 1, 6 and 14, be formed in the most varied shapes. The spout lip 2*d* following the spout 2*b* could also be dispensed with, in particular with liquids with a low viscosity such as water. The spout lip 2*d* is of particular significance to avoid or reduce a forming of drops at the end region of the spout 2*b* or of the spout lip 2*d* with media having a higher viscosity. This reduces the contamination of the closure 1 and in particular the outer side of the container 4, in particular the container jacket, by the leaving medium. The outer envelope 2*a* merges at the bottom into the hollow cylindrical guide part 2*c* which has an inner guide 2*g* extending completely in the peripheral direction as well as two projecting hemispheres 2*h*. The spout 2*b* or the spout lip 2*d* possibly arranged subsequently thereto is arranged projecting outwardly in the radial direction with respect to the axis of rotation D in a preferred embodiment such that the tip of the spout 2*b* or of the spout lip 2*d* projects beyond the guide part 2*c* in the direction radial with respect to the axis of rotation D, as shown in FIG. 6.

In an advantageous embodiment, the spout 2*b* is, as shown in FIGS. 5 and 6, bounded by two laterally arranged side walls which preferably extend mutually in parallel. The spout 2*b* is open toward the top. The beak-like spout 2*b* shown in FIG. 6 or the spout 2 has the advantage that the liquid, in a similar manner to a jug having a beak-like spout, can be poured out in a directed manner so that a glass, for example, can be filled in a simple manner. In the lower region of the spout 26, the liquid flows out, whereas in the upper region of the spout 2*b*, air flows via the spout 2*b* into the base body 2 and subsequently into the container 4 arranged subsequently. The closure 1 in accordance with the invention therefore has a similar outflow behavior as known from cans and jugs.

Figure 11:
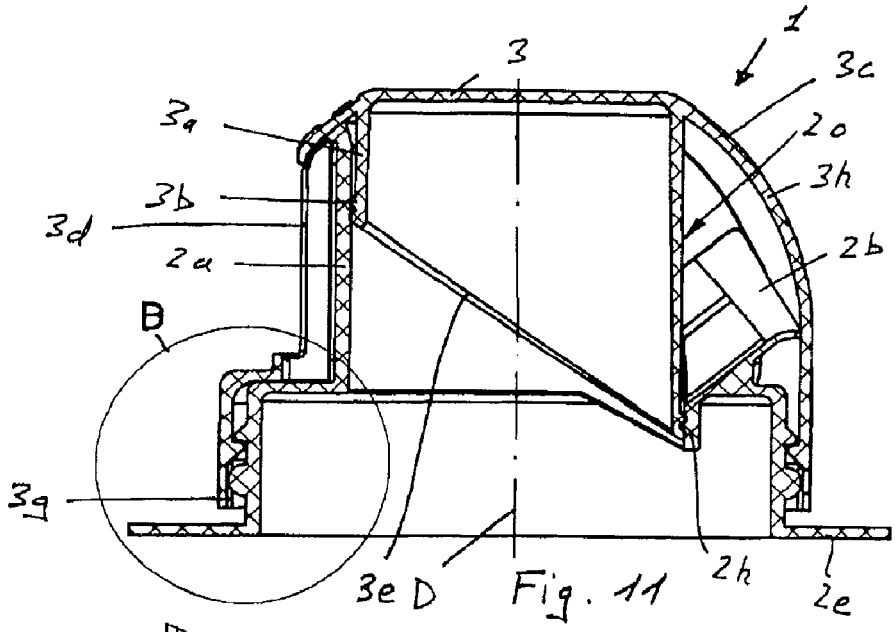
FIG. 11 a longitudinal section through the closure in a closed position.

FIG. 7 shows a perspective view of the closing cap 3. As already shown in FIG. 1, the closing cap 3 includes an outer jacket 3*c* having a knurl 3*i* as well as an opening 3*d* and a cover part 3*h*. The inner sleeve 3*a* arranged inside the closing cap 3 can be recognized through the opening 3*d* and has an end section 3*e* cut obliquely with respect to the axis of rotation D and having an outwardly disposed peripheral sealing lip 3*b* along the total periphery. FIGS. 10 and 11 show longitudinal sections of the closure 1, with these sections each extending through the tip of the spout 2*b* or the tip of the spout lip 2*d*. The sectional planes B and C drawn in FIG. 7 show the position of the sections of the closing cap 3 shown in FIGS. 10 and 11. It can thus be seen that the position of the base body 2 is identical in FIGS. 10 and 11, whereas the closing cap 3 is rotated by the angle δ, in the embodiment shown by 150 degrees. The maximum angle δ can also be selected to be larger, for example 180 degrees, or up to 250 degrees, to achieve a complete opening of the spout opening 2*o*. The closure 1 could also be configured such that a minimal angle δ of 45 degrees is already sufficient to achieve a complete opening of the spout opening 2*o*.

FIG. 8 shows a longitudinal section through the closing cap 3 along the sectional plane B shown in FIG. 7. The end 3*e* of the inner sleeve 3*a*, which extends obliquely with respect to the axis of rotation D, is preferably chamfered as shown such that the shortest section of the inner sleeve 3*a* is located at the side of the opening 3*d* to thereby give the opened closure 1*a* spout opening 2*o* which is as large as possible. The outer jacket 3*c* has, at the bottom, a sleeve-like guide part 3*m* whose inner side has an outer guide 3*f* extending in a circular manner in the peripheral direction, a groove 3*k* and two recesses 3*g*.

FIG. 9 shows a longitudinal section through the closing cap 3 along the sectional plane C shown in FIG. 7.

FIG. 10 shows the closure 1 with a base body 2 and the closing cap 3 arranged thereabove, as shown in FIG. 9, in a completely open position, also designated as the second defined rotary position R2. The contents of the container, not shown, can thus flow out in the direction of flow S via the lateral spout opening 2*o* which results between the lower end 3*e* of the inner sleeve 3*a* and the spout 2*b*.

The longitudinal section shown in FIG. 11 shows the closure 1 in a completely closed position, also designated as the first defined rotary position R1. The base body 2 is located in the same position with respect to the closure 1 shown in FIG. 10, whereas the closing cap 3 is rotated by 150 degrees so that the opening 3*d* is now located on the left hand side and the outer jacket 3*c* was pushed over the spout 2*b* so that it is protected from a mechanical effect or also from contamination by the cover part 3*h* of the outer jacket 3*c*. As shown in FIGS. 7 and 11, the inner sleeve 3*a* has also rotated by 150 degrees by the rotation of the closing cap 3. The inner sleeve 3*a* now contacts the outer sleeve 2*a*, at least in the end region 3*e*, over the whole outer periphery so that the spout opening 2*o* is closed and the contents of the container, not shown, cannot leave the base body 2 or the inner space of the outer sleeve 2*a* or the inner space of the inner sleeve 3*a*. The closure 1 is thus leak-proof. To improve the sealing effect, the inner sleeve 3*a* can have one or more projecting sealing lips 3*b* on its outer side which preferably extend over the total outer periphery of the inner sleeve 3*a* in order to achieve an improved sealing effect between the inner sleeve 3*a* and the outer sleeve 2*a*. The outer sleeve 2*a* and the inner sleeve 3*a* are made to extend mutually matched such that they cooperate in the position shown in FIG. 11 such that the arrangement is leak-proof or substantially leak-proof. In this connection, in particular the outer sleeve 2*a* in the region of the spout 2*b* as well as the extent of the end sections 3*e* are made mutually matched such that the mutual contact surfaces extend in circular shape in the plan view in accordance with FIG. 5 to achieve a reliable sealing effect. The demands made on the sealing effect of the closure 1 depend inter alia on the substance located in the container. If the substance is, for example, a pourable medium, for example salt or sugar, and if there is still even a small gap between the inner sleeve 3*a* and the outer sleeve 2*a*, a good sealing effect can be achieved with respect to this substance. If the substance is liquid or even gaseous, a closure 1 with a correspondingly higher sealing effect is required.

The rotatable, reclosable closure 1 includes a base body 2 and a closing cap 3, wherein the closing cap 3 is rotatably supported around a common axis of rotation D with respect to the base body 2, wherein the base body 2 includes an outer sleeve 2*a* extending coaxially to the axis of rotation D and having a laterally projecting spout 2*b*, and wherein the closing cap 3 has an inner sleeve 3*a* extending coaxially to the axis of rotation D, and wherein the inner sleeve 3*a* is arranged inside the outer sleeve 2*a*, and wherein the inner and outer sleeves 3*a*, 2*a* are made mutually matched such that the closure 1 has a first defined rotary position R1 in which the inner space of the outer sleeve 3*a* opening into the spout 2*b* is sealed by the inner sleeve 3*a*, and wherein the closure 1 has a second defined rotary position R2 in which the inner sleeve 3*a* at least partly frees the inner space of the outer sleeve 2*a* toward the spout 2*b*, and wherein the closing cap 3 has an outer jacket extending outside the outer sleeve 2*a* in the direction of the axis of rotation D and has an opening 3*d*, wherein the outer jacket 3*c* is disposed above and covers the spout 2*b* in the first defined rotary position R1, and wherein the opening 3*d* is disposed above the spout 2*b* and makes it accessible to the outside in the second defined rotary position R2.

The closure in accordance with the invention is suitable for containers with the most varied contents, for example for liquid or pasty media, or for bulk goods such as powder. The sealing lip 3*b* can also be omitted in dependence on the contents of the container, e.g. when the container is a pourable material which does not make any high demands on the seal.

Figure 12:
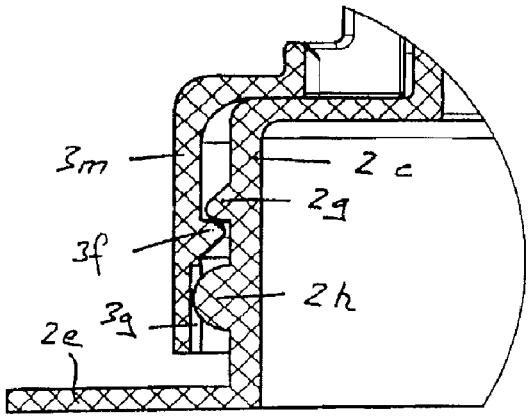
FIG. 12 a detailed view of the outer guidance of the cap on the base body.
Figure 23:
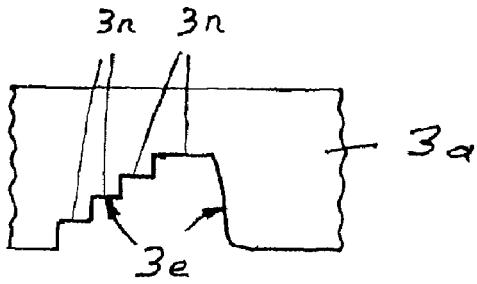
FIG. 23 a side view of a development of an inner sleeve made with steps.

In a preferred embodiment, the base body 2 has a snap connection into which the closing cap 3 can latch. For this purpose, the closing cap 3 is pushed onto the base body 2 in the position shown in FIG. 11 and is pressed down until the outer guide 3*f* of the closing cap 3 latches into the inner guide 2*g* of the base body 2. The closing cap 3 could also be connected to the base body 2 by screwing on, via a bayonet, via a groove or a cam track, by press-on or screwing. FIG. 12 shows this connection of the base body 2 and the closing cap 3 in detail. The inner guide 2*g* extends coaxially to the axis of rotation D. In an advantageous aspect, the guide part 2*c* has projecting latch elements such as a hemisphere 2*h* and the outer guide 3*f* has correspondingly matched grooves 3*k* and/or, as shown, recesses 3*g* which mutually latch so that the closure 1 has at least two, and preferably a plurality of defined latching positions during rotation. The closing cap 3 advantageously perceptibly latches in at least the first and second defined rotary positions R1, R2 so that it is perceptible by hand that these settings have been reached during the turning of the closing cap 3. Such defined latching positions and intermediate positions have the advantage that the size of the spout opening 2*o* can be set in a defined manner. A perceptible latching preferably also occurs in the intermediate positions, if present, during turning. For example, two additional intermediate positions spaced apart by the same angle of rotation could be provided between the first and second defined rotary positions R1, R2 so that the closing cap 3 can be latched in four defined positions with respect to the base body 2. In this connection, the inner sleeve 3*a* could, as shown in a development in FIG. 23, have a step-shaped end section 3*e* with differently high openings 3*n*, with each opening 3*n* being associated with one of the four defined latch positions. The spout 2*b* preferably has a width corresponding to that of an opening 3*n* so that the four defined openings 3*n* of different sizes form, together with the spout 2*b*, four spout openings 2*o* of different sizes by rotation of the closing cap 3. These four adjustable spout openings 2*o* of different sizes are advantageous for the metered dispensing of the container contents, for example of cream, sugar or even pepper. It can prove to be advantageous to provide the base body 2 and the closing cap 3 with markings such that the four defined latch positions can be set simply.

The mutually rotatable guidance of closing cap 3 and base body 2 takes place at least via the guide part 3*m* of the closing cap 3 and the guide part 2*c* of the base body 2, said guide parts 2*c*, 3*m* enabling a mutual rotation around the axis of rotation D. A second guide of the closing cap 3 and the base body 2 can result by the inner sleeve 3*a* rotatably supported in the outer sleeve 2*a*.

Figure 13:
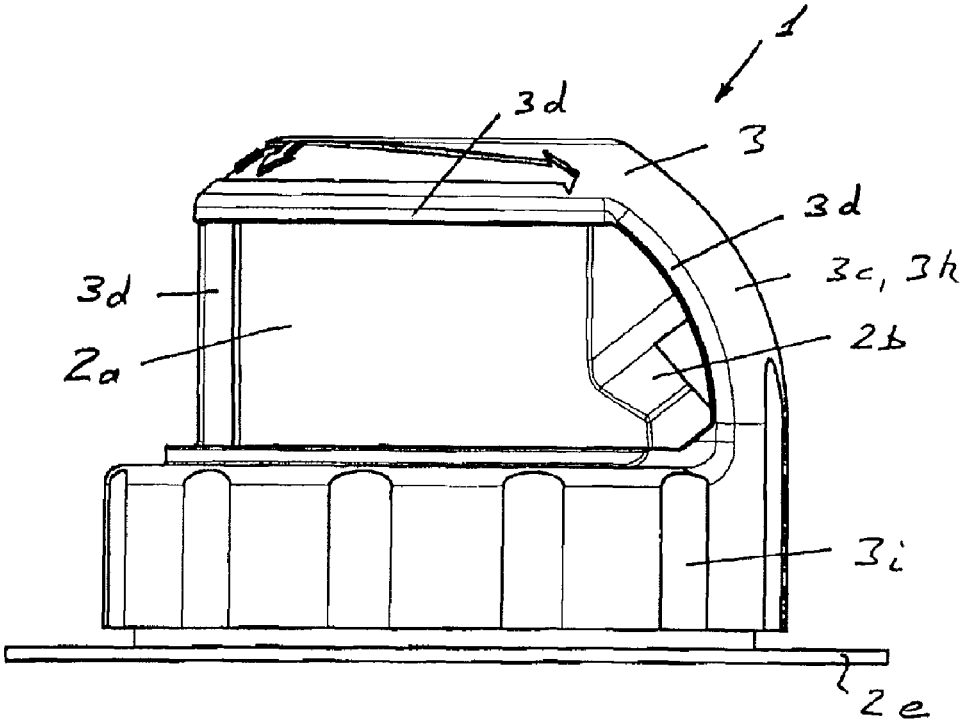
FIG. 13 a side view of the closed closure in accordance with FIG. 3.

Unlike FIG. 3, FIG. 13 shows a side view of the closed closure 1. In particular the closing cap 3 and its opening 3*d* as well as partly the outer sleeve 2*a* and the spout 2*b* can be seen. The spout 2*b* is located inside the closing cap and is therefore covered by it and is protected against mechanical damage and contamination.

Figure 14:
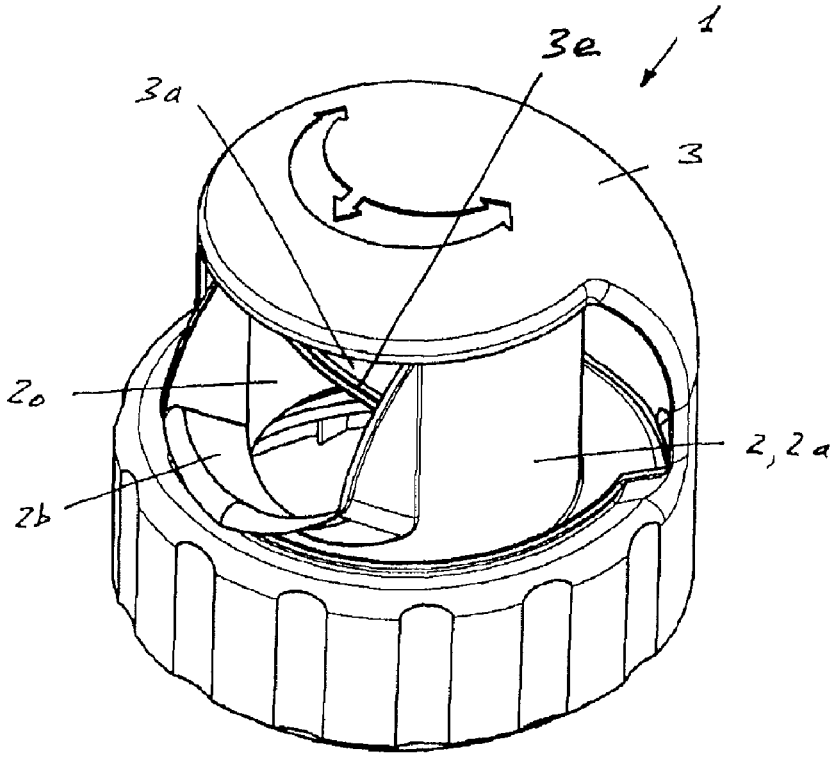
FIG. 14 a perspective view of a second embodiment of a closure.
Figure 15:
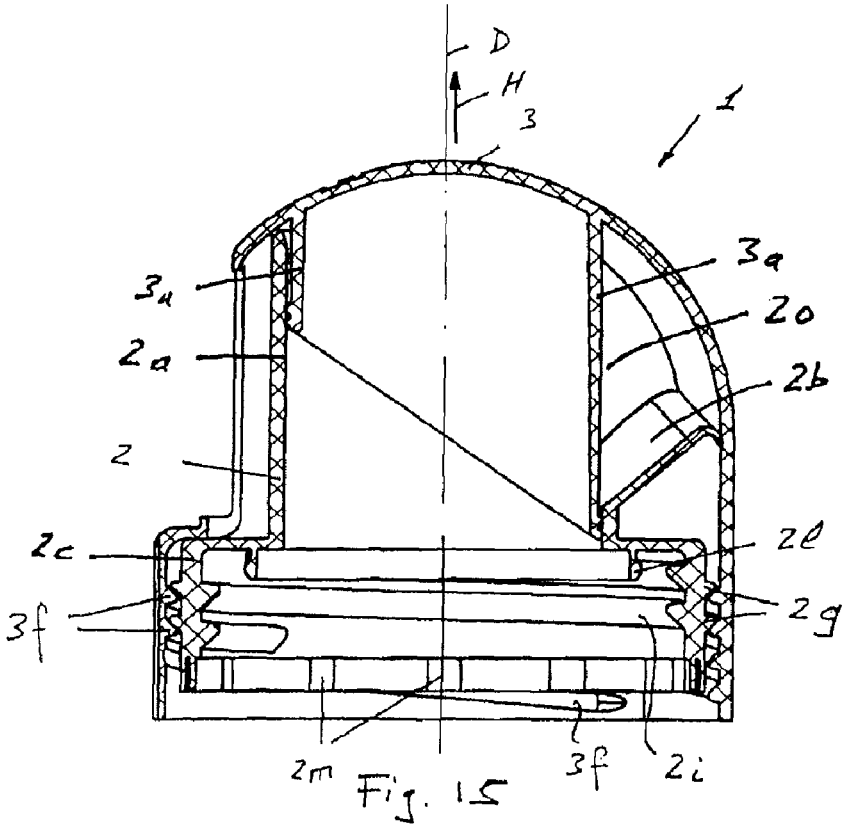
FIG. 15 a longitudinal section through the closure in accordance with FIG. 14 in a closed position.
Figure 16:
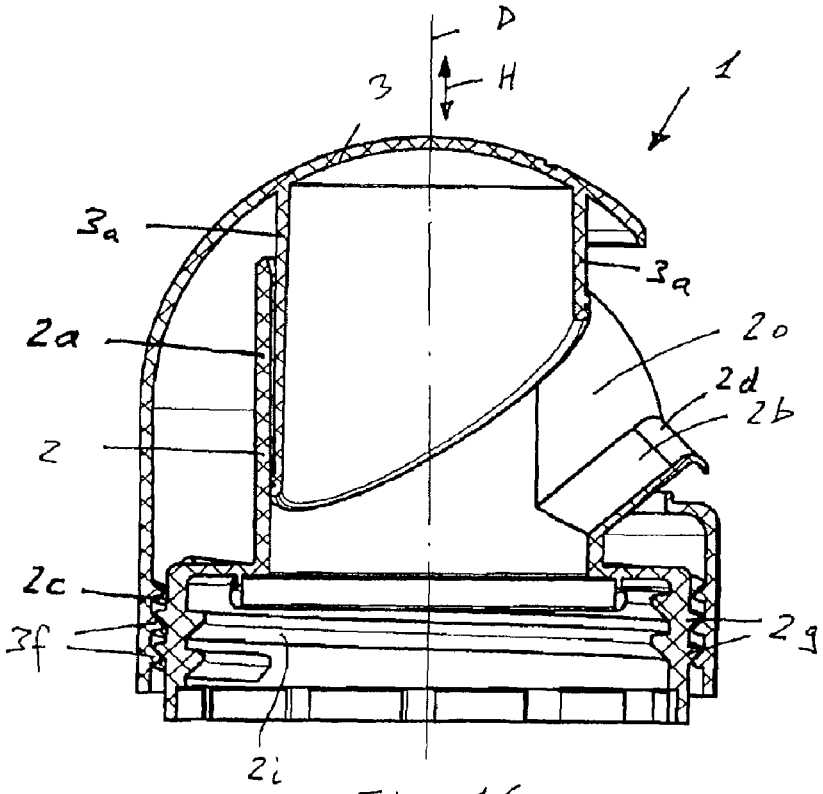
FIG. 16 a longitudinal section through the closure in accordance with FIG. 14 in a completely open position.

FIG. 14 shows a second embodiment of a closure 1 which is shown in the completely open position. This closure 1 is suitable for fastening to a container with a thread. This closure has a differently configured spout 2*b* in comparison with the first embodiment in accordance with FIGS. 1 to 13. FIGS. 15 and 16 show longitudinal sections of the closure 1 shown in FIG. 14 in an analogous rotation position of the closing cap 3 with respect to FIGS. 11 and 10. The closure 1 shown in FIG. 15 is configured substantially the same as the closure 1 shown in FIG. 11, but differs, on the one hand, in that the base body 2 has an internal thread 2*i* and latching webs 2*m*. In addition, a peripheral, elastic sealing lip 2*l* is arranged in the base body 2 to enable a fluid-tight connection of the base body 2 and a bottleneck. The closure 1 in accordance with FIG. 15 additionally differs from the closure 1 in accordance with FIG. 11 in that the inner and outer guides 2*g*, 3*f* are made as threads, which consequently has the effect that, as shown in FIG. 16, the closing cap 3 is additionally raised in the direction of movement H in the direction of extent of the axis of rotation D on rotation, which in particular results in the advantage that a larger spout opening 2*o* thereby arises. On the closing of this closure 1, it again moves downwardly in the direction of movement H in the direction of extent of the axis of rotation D so that the closed closure 1 again adopts the position shown in FIG. 15. Instead of a thread, the closure 1 can, for example, also have a cam track, with a tongue and groove guide, or a groove or a bayonet fastening to effect the movement of the closure 1 in the direction H.

Depending on the pitch of the thread, the maximum possible stroke H is in the range between 0 mm and 40 mm, preferably between 0 mm and 15 mm, and in particular between 0 and 5 mm. In the embodiment in accordance with FIG. 10, the height of the spout opening 2*o* in the direction of the axis of rotation D amounts to approximately 20 mm and the width to approximately 20 mm. The additional vertical gain by the stroke movement H is preferably in the range between 10% and 50%.

In an advantageous aspect, the spout lip 2*d* of the spout 2*b* is configured to extend such that it contacts the inner wall of the closing lid 3 in the closed closure position as shown in FIG. 15. This aspect has the advantage that the inner space of the spout 2*b* is protected from external contamination in the closed state. The closure 1 shown in FIGS. 1 to 13 could also have spout lips 2*d* configured to match with respect to the closing cap 3.

Figure 17:
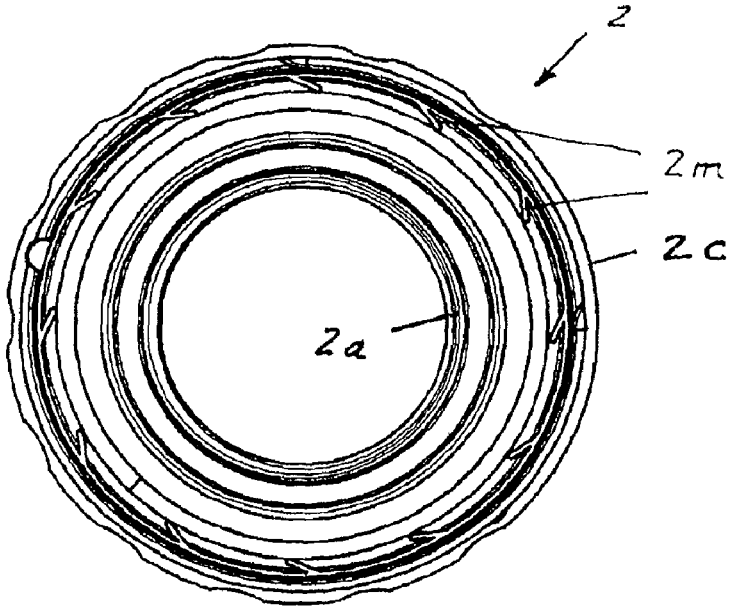
FIG. 17 a view of the closed closure in accordance with FIG. 14 from below.

FIG. 17 shows the closure in accordance with FIGS. 14 to 16 in a view from below, with projecting latching webs 2*m* which engage at the container, for example at the bottle edge, to avoid or to reduce a relative movement between the container and the base body 2 in the assembled state, in particular on the opening and closing of the closure 1 to prevent a release of the closure from the container or to avoid or reduce the closure being completely removed from the container.

Figure 18:
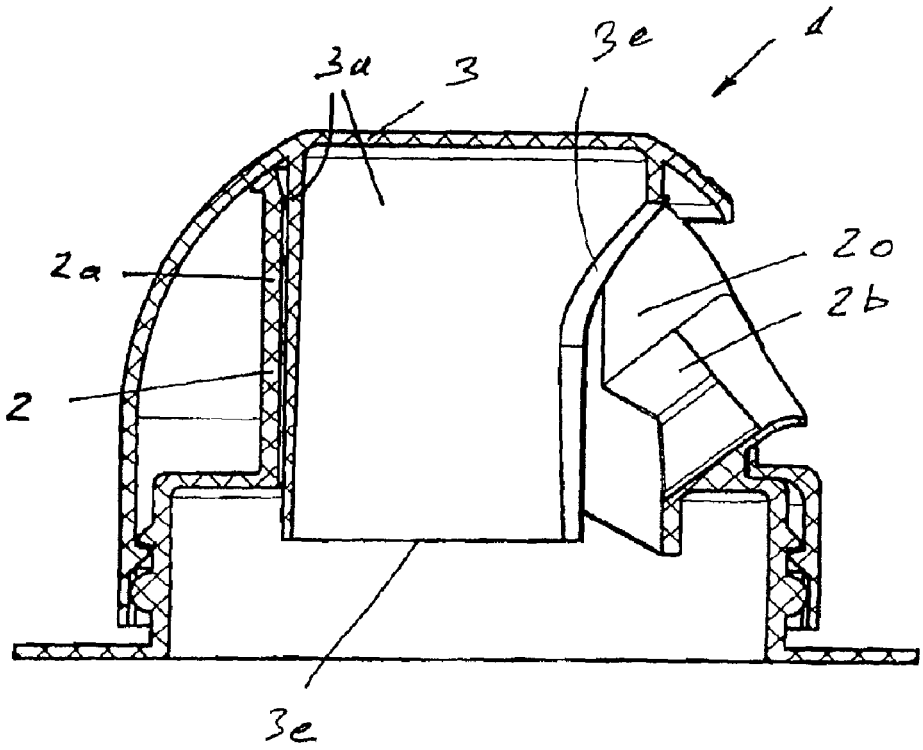
FIG. 18 a longitudinal section through a further embodiment of a closure.

FIG. 18 shows a longitudinal section of a further embodiment of a closure 1. Unlike the embodiment shown in FIG. 10 with an obliquely extending end section 3*e*, the end section 3*e* in FIG. 10 extends along a part section of the periphery perpendicular to the axis of rotation D, and subsequently substantially in U shape. As can be seen from FIG. 18, this results in a spout opening 2*o* of a particularly large area since the lateral opening of the inner sleeve 3*a* is pulled up far to the top. The sealing lips 3*b* can extend following the contour of the end section 3*e* or, as shown in FIGS. 7 and 8, for example, can extend obliquely to the axis of rotation D.

Figure 21:
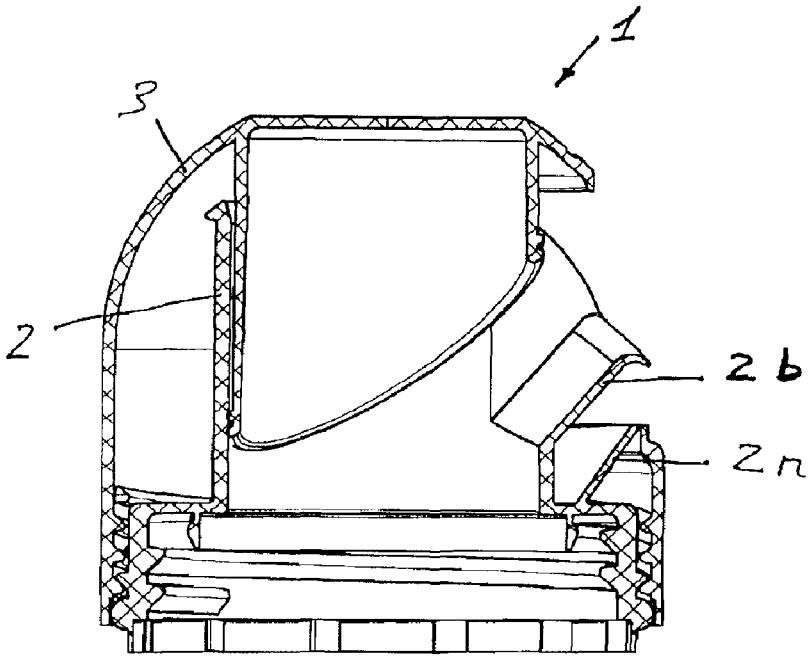
FIG. 21 a longitudinal section through a further embodiment of a closure with a return pan.

FIG. 19 shows a further embodiment of a closure 1 whose closing cap 3 has a return 2*n* beneath the spout 2*b* which opens into a return opening 2*p* of the outer sleeve 2*a*. A drop hanging at the spout 2*b* thus flows via the return 2*n* and the return opening 2*p* back into the base body 2 and thereafter into the container, provided that the closure 1 is in an open position. The return opening 2*p*, in particular its gap width and height, is configured geometrically such that it is made possible that a drop or the fluid can flow back into the bottle after the pouring out, but that no fluid, or only a small amount, can exit through the return opening during the pouring out. The return opening 2*p* is preferably arranged such that it is likewise closed by the inner sleeve 3*a*, provided that the closure 1 is located in the closed position. The return opening 2*p* can, as shown, be configured as an elongate gap, but also in a plurality of different forms, for example as a plurality of round holes. FIG. 20 shows a longitudinal section along the sectional plane E through the base body 2, so that the return 2*n* with return opening 2*p* is visible. The return opening 2*p* connects the inner space of this base body 2 to its outer space. FIG. 21 likewise shows a longitudinal section through a base body 2 along the sectional plane E, with the base body 2 having a return 2*n* which opens into a return pan. The return 2*n* or the return pan does not have a return opening and thus no fluid-conducting connection to the inner space of the base body 2. The return 2*n* shown in FIG. 20 with return opening 2*p* and the return 2*n* shown in FIG. 21 with return pan can be combined as desired in a closure 1, for example such that a closure 1 has two returns 2*n* disposed above one another with one return opening 2*p* each, or a return 2*n* with a return opening 2*p* as well as a return 2*n* arranged disposed below it with a return pan, or two returns 2*n* arranged above one another with return pans so that the closure 1 includes two separate return pans.

Figure 24:
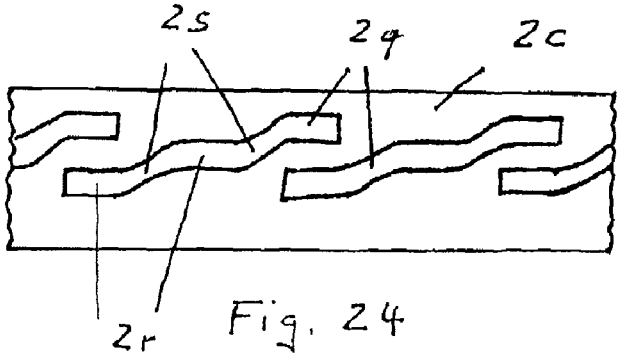
FIG. 24 a side view of a development of a guide part with a groove.
Figure 25:
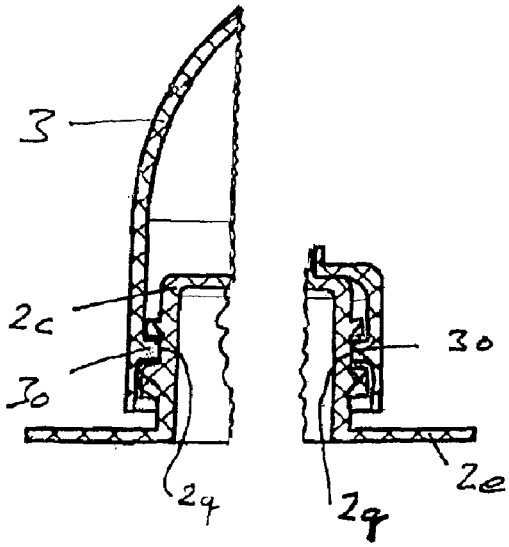
FIG. 25 a longitudinal section through a closure with guides for the groove in accordance with FIG. 24.

FIGS. 24 and 25 show a vertically adjustable closure 1 with cam track and control cam. FIG. 24 shows the development of the outer side of a guide part 2*c* which has guide grooves 2*q* extending in the peripheral direction or a control cam, with these guide grooves 2*q* having defined positions 2*r* and transition positions 2*s*. FIG. 25 schematically shows a longitudinal section through a closure 1, with the closing cap 3 having projecting holding elements 3*o* which engage into the guide grooves 2*q*. On the rotation of the closing cap 3, it thus moves in accordance with the stroke preset by the guide grooves 2*q* in the direction of the axis of rotation D.

Figure 22:
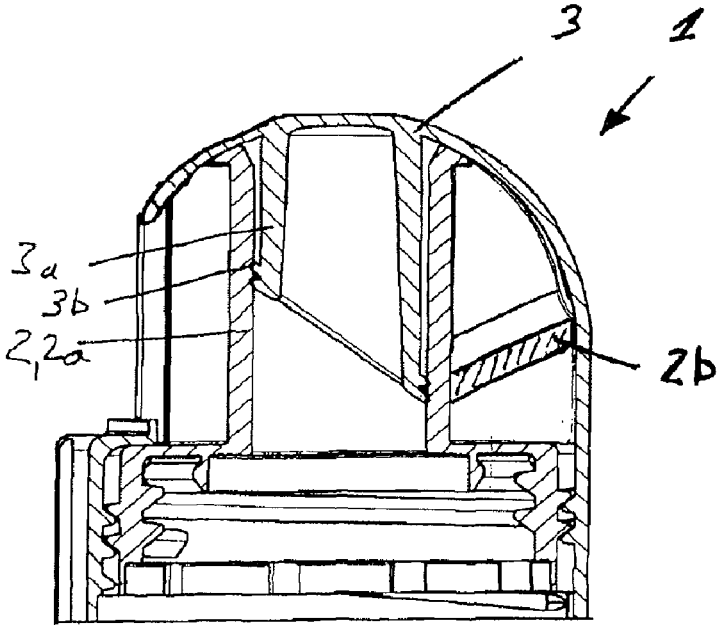
FIG. 22 a longitudinal section through a further embodiment of a closure.

FIG. 22 shows a longitudinal section through a closure 1 which is also suitable as a pressure closure. The inner sleeve 3*a* and the outer sleeve 2*a* have an increased wall thickness and the inner sleeve 3*a* is configured to extend in a slightly V shape. The higher the pressure in the interior of the container, the more strongly the inner sleeve 3*a* is pressed against the outer sleeve 2*a*, which increases the sealing effect of the sealing lips 3*b*.

Figure 26:
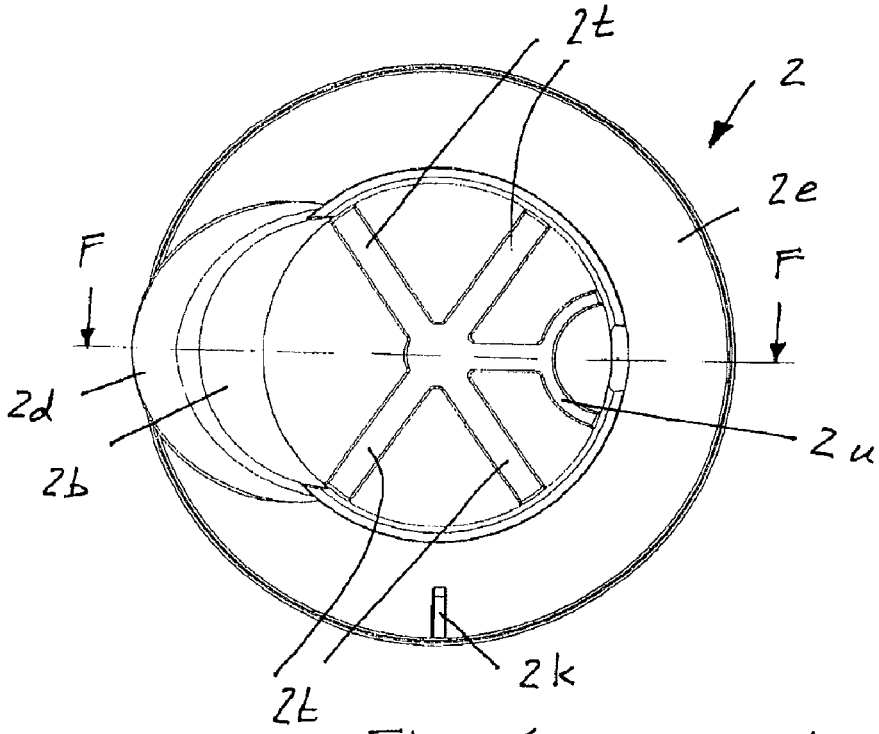
FIG. 26 a plan view of a further embodiment of a base body.

FIG. 26 shows a plan view of a further embodiment of a base body 2 which, unlike the embodiment shown in FIG. 5, has a plurality of webs 2*t* as well as a venting passage 2*u*, which should serve the purpose of influencing, in particular calming, the flow behavior of an outflowing liquid. This is called "flow control" in English. The venting passage 2*u* is advantageously arranged opposite the spout 2*b*. During the pouring out, air usually flows via the spout 2*b* and the venting passage 2*u* back into the inner space of the container 4.

Figure 27:
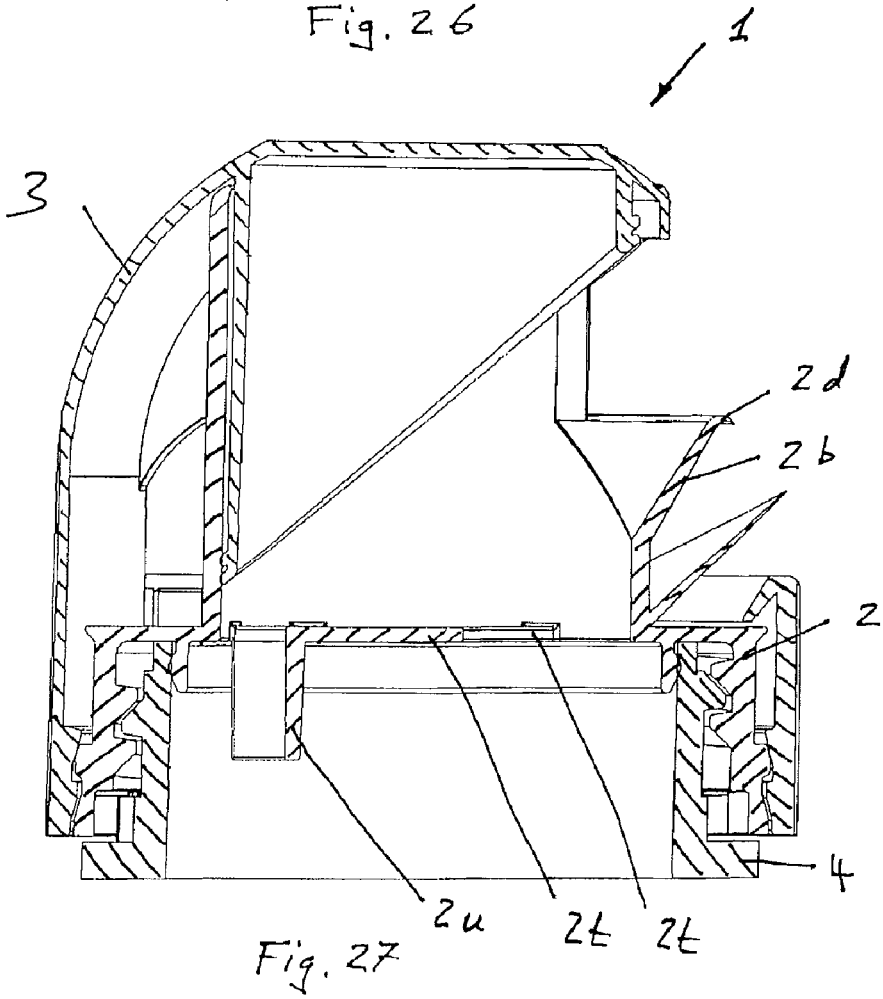

FIG. 27 shows a longitudinal section through the base body 2 shown in FIG. 26 along the line F-F. In contrast to the representation in accordance with FIG. 26, FIG. 27 additionally shows a closing cap 3 placed onto the base body 2 as well as a container neck 4 onto which the base body 2 is screwed. As can be seen from the longitudinal section in accordance with FIG. 27, the flow control comprising the webs 2*t* and the venting passage 2*u* is preferably arranged directly at the outlet opening of the container 4 to calm the outflowing liquid and in particular to guide it toward the spout 2*b*.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A rotatable, reclosable closure (1) comprising:

a base body (2) coupled to a closing cap (3), wherein the closing cap (3) is rotatably supported around a common axis of rotation (D) with respect to the base body (2), wherein the base body (2) includes an outer sleeve (2*a*) extending coaxially to the axis of rotation (D) and having a laterally projecting spout (2*b*), and wherein the closing cap (3) has an inner sleeve (3*a*) extending coaxially to the axis of rotation D, and wherein the inner sleeve (3*a*) is disposed inside the outer sleeve (2*a*), and wherein the inner and outer sleeves (3*a*, 2*a*) are configured such that the closure (1) has a first rotary position (R1) in which an inner space of the outer sleeve (2*a*) opening into the spout (2*b*) is sealed by the inner sleeve (3*a*), and wherein the closure (1) has a second rotary position (R2) in which the inner sleeve (3*a*) at least partly frees the inner space of the outer sleeve (2*a*) toward the spout (2*b*), and wherein the closing cap (3) has an outer jacket (3*c*) extending outside the outer sleeve (2*a*) in the direction of the axis of rotation (D) and having an opening (3*d*), wherein the outer jacket (3*c*) is disposed above the spout (2*b*) and configured to cover the spout (2*b*) in the first rotary position (R1), and wherein the opening (3*d*) is disposed above the spout (2*b*) and configured to allow access from the outside in the second rotary position (R2), and wherein the spout (2*b*) is configured to extend at an acute angle ($\alpha$) with respect to the axis of rotation (D).

2. The closure in accordance with claim 1, wherein the base body (2) includes a round guide element (2*c*) configured to rotatably support the outer jacket (3).

3. The closure in accordance with claim 2, wherein the tip of the spout (2*b*) is configured to project beyond the guide element (2*c*) in a radial direction with respect to the axis of rotation (D).

4. The closure in accordance with claim 2, wherein the outer jacket (3*c*) is configured to allow vertically adjustable support with respect to the guide element (2*c*), such that rotation of the closing cap (3) results in displacement of the closing cap (3) with respect to the base body (2) in the direction of the axis of rotation (D).

5. The closure in accordance with claim 1, wherein the inner sleeve (3*a*) has a sealing lip (3*b*) that is configured to project toward the outer sleeve (2*a*), that is further configured to extend over the entire periphery of the inner sleeve (3*a*) and that is still further configured to contact the outer sleeve (2*a*) in dependence on the rotary position of the closing cap (3).

6. The closure in accordance with claim 1, wherein the inner sleeve (3*a*) has an end (3*e*) extending obliquely with respect to the axis of rotation (D).

7. The closure in accordance with claim 6, wherein the obliquely extending end (3*e*) is disposed with respect to the opening (3*d*) and the outer jacket (3*c*) such that the inner space of the inner sleeve (3*a*) is freed toward the opening (3*d*).

8. The closure in accordance with claim 1, wherein the spout (2*b*) has a spout lip (2*d*), wherein the spout lip (2*d*) and the outer jacket (3*c*) are configured to mutually match such that the spout lip (2*b*) projecting in a radial direction with respect to the axis of rotation (D) is coverable by the outer jacket (3*c*).

9. The closure in accordance with claim 1, further comprising a plurality of abutments (3*l*) and abutment webs (2*k*) that are configured to limit rotation of the closing cap (3) with respect to the base body (2) to thereby define the first and second rotary positions (R1, R2).

10. The closure in accordance with claim 1, further comprising a latching device that is configured to lock the closing cap (3) in a specific rotary position with respect to the base body (2).

11. The closure in accordance with any one of claim 9 or claim 10, comprising a further defined rotary position (R3) with which a specific reduced spout opening (2*o*) is associated.

12. The closure in accordance with claim 1, wherein the base body (2) has a fastening element selected from the group consisting of a flange for adhesive bonding, a flange for press-on, a flange for welding, and an internal thread for screwing on.

13. The closure in accordance with claim 1, wherein the closing cap (3) is coupled to the base body (2) via a thread, a bayonet fastening, or a groove.

14. The closure in accordance with claim 1, wherein the closure (1) includes a control cam (2*q*) that is configured to determine relative movement of the base body (2) and the closing cap (3) in a direction of the common axis of rotation (D) as a function of a rotary angle to effect a variation in height (H).

15. The closure in accordance with claim 1, further comprising a return (2*n*) that is coupled to the closure beneath the spout (2*b*), wherein the return (2*n*) is configured such that the return collects drops hanging at the spout (2*b*).

16. The closure in accordance with claim 15, wherein the outer sleeve (2*a*) has a return opening (2*p*) that is configured to connect the inner space of the base body (2) to the outer space, and wherein the return (2*n*) is configured to open into the return opening (2*p*).

17. The closure in accordance with any one of claim 15 or claim 16, wherein the return (2*n*) is configured to open into a return pan.

* * * * *